United States Patent [19]

Nicholson et al.

[11] 3,937,176

[45] Feb. 10, 1976

[54] TABLET COATING APPARATUS WITH UNLOADER

[75] Inventors: David W. Nicholson, Indianapolis; Gerrit J. Diepering, Franklin, both of Ind.

[73] Assignee: Eli Lilly and Company, Indianapolis, Ind.

[22] Filed: Feb. 19, 1975

[21] Appl. No.: 551,191

[52] U.S. Cl. ..... 118/19; 193/10

[51] Int. Cl.[2] ..... B05C 3/08

[58] Field of Search ..... 118/19, 418, 303; 427/242; 193/10; 259/30–33; 222/167

[56] References Cited

UNITED STATES PATENTS 947,196 7/1910 Cropp ..... 193/10 X

*Primary Examiner*—Morris Kaplan

*Attorney, Agent, or Firm*—Houston L. Swenson; Everet F. Smith

[57] ABSTRACT

Tablet coating and polishing apparatus comprising a conventional rotatable pan with a gravity discharge unloader chute connected for rotation therewith. The unloader chute has an inlet associated with the interior of the pan and an outlet exterior of the pan with a substantially truncated conical surface extending therebetween and having a progressively increasing width toward said outlet for gravity unloading of tablets from the pan.

4 Claims, 8 Drawing Figures

TABLET COATING APPARATUS WITH UNLOADER

BACKGROUND OF THE INVENTION

Conventional tablet coating and polishing apparatus which have been in use for a number of years generally comprise a large drum or pan that is mounted on a rotatable axis. Tablets for pharmaceutical purposes as well as other uses are placed into the pan and upon rotation of the pan a coating material is applied. The pan rotates at a relatively slow speed such as 20–25 RPM. After a sufficient number of coatings have been applied to the tablets they are ready for removal from the pan. In small coating apparatus, removal of the tablets can be made by hand. However, when production is on a large scale and pans of approximately 48 inch diameter are used it is apparent that the removal of about nine cubic feet of tablets becomes burdensome if done by hand. Thus, apparatus have been designed for inserting into conventional coating pans which will cause the tablets to be removed automatically by gravity feed.

U.S. Pat. No. 2,807,230, C. H. Brammar, issued in 1957, relates to an unloading device that may be removably coupled to a coating pan. The structure in that pan was designed for a coating pan having a horizontal axis. In particular, it utilizes a chute having an inlet which will scoop up a quantity of tablets from the bed of the tablets as the pan rotates. When the chute rotates from a lower position where it has scooped up tablets to a higher position the tablets begin to flow through the chute by gravity and will eventually flow to an outlet of the chute which is positioned on the exterior of the pan through its opening. It is apparent that in order for the tablets to flow through the unloader chute by gravity that the chute must be positioned at an angle to the horizontal axis of the pan. In the Brammar structure this angle can be approximately 30°–40°.

In more recent years the popularity of tablet coating pans on an inclined axis has grown significantly. Attempts to apply unloading chutes of the type taught in the Brammar patent to coating pans having an inclined axis of rotation have not led to satisfactory results. As taught in the Brammar patent it is necessary for the unloading chute to be at an angle to the axis of rotation of the coating pan which is greater than the angle between the horizontal and the axis of rotation of the coating pan in order that gravitational flow can occur. Therefore, as the axis of the pan is raised on an incline the maximum of available discharge angle for the unloader chute decreases. Consequently, the travel speed of tablets exiting through the chute will decrease. This in turn will require the pan to rotate at a much slower speed in order for a Brammar unloader to completely discharge all of the tablets collected during each rotation. Depending on the angle of the pan axis and its rotational speed it is quite possible that there will be recirculation of tablets within the unloader chute. This inability to completely discharge all of the tablets collected during each rotation will cause damage to the tablets in many instances since they are colliding with each other at a fairly substantial force.

SUMMARY OF THE INVENTION

Our invention deals with the above mentioned problems by making improvements in the unloader chute. Contrary to the conventional unloader chutes our structure utilizes a truncated conical surface that extends between the chutes inlet and outlet which has a progressively increasing width toward its outlet. Thus, the unloader chute of our invention utilizes a small collection end at its inlet and a wide discharge end which permits the tablets to flow sooner and therefore to flow for a longer portion of each rotation of the pan. This ability to completely discharge all of the tablets and prevent recirculation of them without having to substantially lower the speed of the pan is possible because the tablets are free to slide sideways along the length of the chute as well as straight out the discharge end. Thus, rather than be limited to a slow speed such as five revolutions per minute which would require complicated and expensive mechanical gearing when a conventional 25 rpm pan is used, our invention permits a pan to be electrically slowed to approximately 12 rpm and still achieve complete discharge of tablets each time the pan rotates. For a coating pan having an inclined axis of rotation, a conical conduit having its large end on the inside of the pan, as taught in the Brammar patent, would have the opposite effect.

DESCRIPTION OF THE PREFERRED EMBODIMENT

Figure 1:
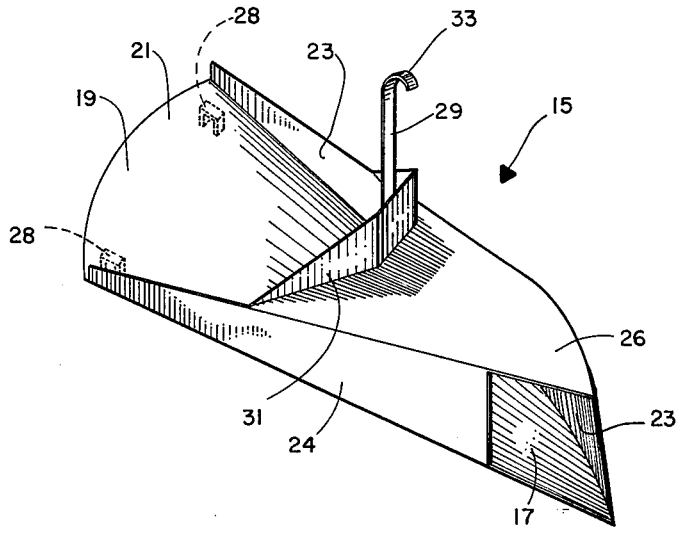
FIG. 1 is a perspective view of the unloader of this invention.
Figure 2:
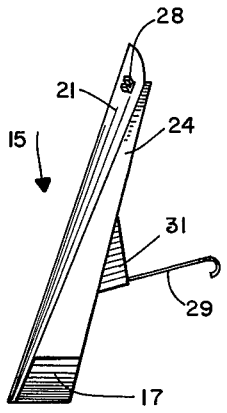
FIGS. 2 through 4 are plan views of the right side, top and left side respectively.
Figure 3:
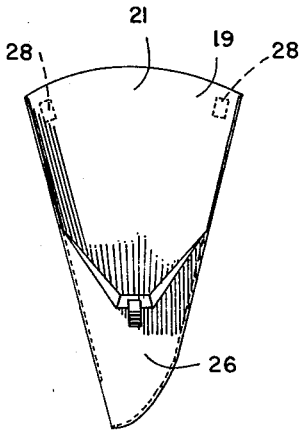

Referring to FIGS. 5 through 8, a conventional coating pan 11 is illustrated which rotates on an axis 12 of about 22 degrees with the horizontal. It is to be understood that the angle on which the pan rotates is not a part of our invention. However, in general, such pans which may have a diameter of approximately 4 feet, are usually on an angle of 22° to 24°. Tablets 14, which tumble on the bottom of the interior of the pan are introduced therein through opening 13. Under normal coating procedures the pan may rotate at approximately 24 rpm. As the tablets slowly tumble over each other during the clockwise rotation of the pan appropriate liquid coating material (not illustrated) may be introduced through the opening 13.

Figure 4:
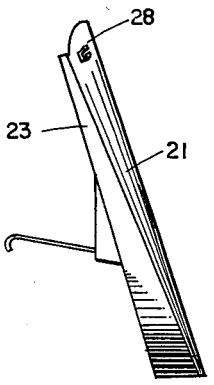

Referring to FIGS. 1 through 4 unloader 15 is illustrated which may be formed from a light weight but strong material such as stainless steel. The unloader of this invention consists of a section of an elliptical cone with its small end or inlet 17 being adjacent to the pan's inside surface and its large discharge end or outlet 19 being adjacent to the pan's opening 13 and extending beyond its perimeter. Referring to FIG. 4 it is to be noted that the bottom wall 21 is approximately a truncated conical configuration and supports the tablets that flow through the unloader. This wall, which is outwardly curved and largest at its outlet 19, may be of a width of approximately 24 inches if designed for a conventional inclined coating pan having a 48 inch diameter. The inlet 17 of the unloader is positioned at the narrowest dimension or width of surface 21 and may be approximately 6 inches. Unloader 15 is provided with a pair of side walls 23 and 24. Side wall 23 curves along the eliptical configuration of surface 21 and defines one edge of inlet 17. Side wall 24 cooperates with top surface 26 to complete the definition of inlet 17. Surface 26 is provided primarily to prevent the initial escaping of tablets as they are scooped up through inlet 17 as well as avoiding overloading the chute. It is not essential that this top surface extend the full length of the unloader.

Since the unloader is to be used only to remove the tablets it is not permanently connected inside the pan during coating. When the tablets are to be removed the unloader is mounted therein by means of clips 28 which extend from the exterior side of surface 21 (FIG. 3) and clamp 29. As shown in FIG. 1, clamp 29 is fastened to the unloader on a reinforcing collar 31 and has a curved end 33 which snaps over circular edge 34 which defines pan opening 13. The pair of clips 28 cooperate with clamp 29 and edge 34 to keep the unloader in its illustrated position relative to the pan throughout rotation. Clamp 29 may have an adjustable length if desired to cause inlet 17 of the unloader to assume a position at a more shallow depth in the tablets nearer outlet 19. This will avoid unwanted unloading of tablet particles and dust that tends to settle at the bottom of the bed of tablets.

Figure 5:
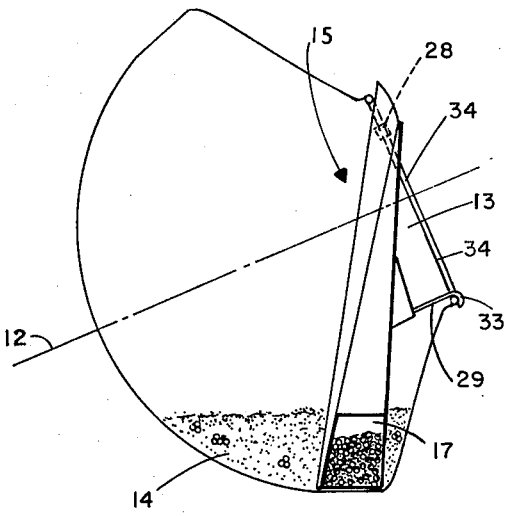
FIG. 5 is a side view of a pan and unloader.
Figure 6:
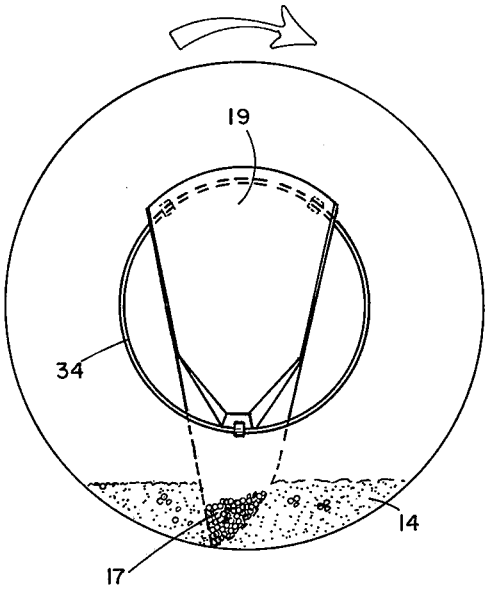
FIGS. 6, 7 and 8 are front views of a pan and unloader taken along the pan's axis and illustrating the sequence of tablet flow.
Figure 7:
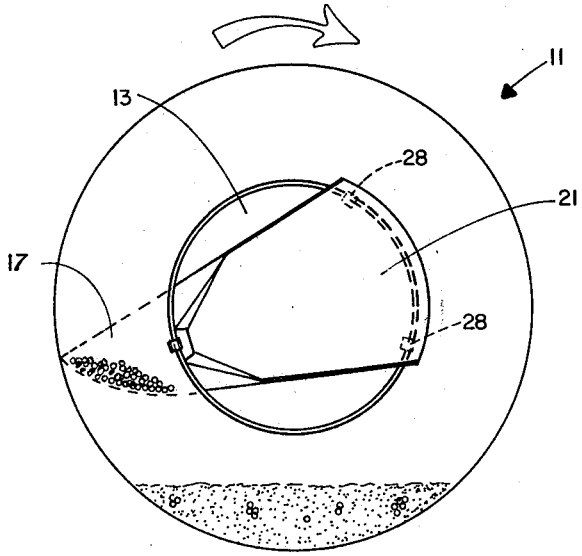
Figure 8:
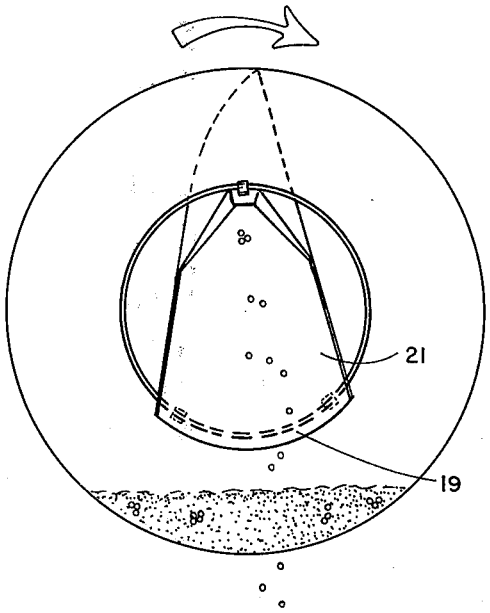

Referring to FIG. 5, chute 15 for maximum unloading may be positioned within the pan 11 at an angle of approximately 78° to the horizontal at its lowest point of its rotation and 34° to the horizontal at its highest point of rotation. In such a manner, the unloader rotates with the pan and, as illustrated in FIG. 6, will scoop up a quantity of tablets on each revolution since the bed of tablets always remain at the bottom of the pan. If the pan is normally wired for rotating at 24 rpm it can be readily reduced by electrical means to half the speed or at 12 rpm. In unloaders of the past such a speed would be considered high and would not be feasible since the tablets scooped up by the unloader would not all be discharged during a single rotation.

However, in our design the provision of surface 21 which increases rather than decreases in its width as it progresses toward its outlet 19 enables the pan to rotate at what heretofore were considered high speeds for purposes of unloading. As the unloader rotates with the pan, its inlet 17 is forced into the bed of tablets and scoops up a large quantity of them. Looking at FIG. 6 the penetration of the unloader's inlet 17 into the bed of tablets occurs at about a position corresponding to the position on a clock of 4 o'clock. The inlet emerges from the bed of tablets at approximately a position of 8o'clock and flow of the tablets due to gravity will commence at about 10 o'clock and continue until 2 o'clock. The average quantity of tablets that can be discharged in this manner during each rotation is approximately 300 cubic inches. Thus, within the short period of 3 to 4 minutes the pan has been emptied. The condition of the tablets unloaded in this manner compare favorably with respect to tablets unloaded by hand. This can be primarily attributed to the fact that there is no recirculation of tablets within the unloader and thus they are not unnecessarily colliding with each other. In such a manner approximately 9 cubic feet of tablets can be removed and in a matter of seconds the unloader can be removed thereby enabling the pan to receive new tablets that are to be coated.

What is claimed is:

1. In a tablet coating pan having an opening and a removable gravity discharge unloader chute with an inlet associated with the interior of said pan the outlet of said chute being removably attached to the edge of said pan opening and an outlet exterior of said pan, for rotation therewith, the improvement comprising a substantially truncated conical bottom wall extending between said chute's inlet and outlet for gravity feeding tablets therebetween and having a progressively increasing width toward said outlet and a top surface cooperating with said bottom wall and a pair of side walls to define said chute's opening.

2. The improvement in accordance with claim 1 in which the width of said substantially truncated, conical surface at the chute's outlet is at least twice its width at the chute's inlet.

3. The improvement in accordance with claim 1 in which said attachment comprises a removable clip.

4. The improvement in accordance with claim 1 in which said attachment comprises a clamp.

* * * * *